US007243647B2

(12) United States Patent
Pianezze

(10) Patent No.: US 7,243,647 B2
(45) Date of Patent: Jul. 17, 2007

(54) UNIVERSAL INTEGRATED DEVICE FOR CONTROLLING GAS-BURNER RINGS OF A COOKING SURFACE INCLUDING A GAS TAP AND A CATENARY ELEMENT

(75) Inventor: Daniele Pianezze, Cassano Magnago (IT)

(73) Assignee: ITW Industrial Components S.r.L., Milan (IT)

( * ) Notice: Subject to any disclaimer, the term of this patent is extended or adjusted under 35 U.S.C. 154(b) by 179 days.

(21) Appl. No.: 10/897,432

(22) Filed: Jul. 23, 2004

(65) Prior Publication Data

US 2005/0045172 A1 Mar. 3, 2005

(30) Foreign Application Priority Data

Jul. 25, 2003 (IT) ..... TO2003A0581

(51) Int. Cl.
*F24C 3/00* (2006.01)

(52) U.S. Cl. ..... 126/39 E; 126/39 BA

(58) Field of Classification Search ..... 126/39 E, 126/39 BA, 39 R, 39 C; 16/2.1; *F24C 3/10*
See application file for complete search history.

(56) References Cited

U.S. PATENT DOCUMENTS

| | | | | |
|---|---|---|---|---|
| 1,988,595 A | | 1/1935 | Hiss | |
| 3,590,652 A | * | 7/1971 | Strang | 74/421 R |
| 3,937,207 A | | 2/1976 | Kendall | |
| 3,953,142 A | * | 4/1976 | Price et al. | 403/371 |
| 4,291,206 A | | 9/1981 | Edmonds | |
| 4,324,517 A | | 4/1982 | Dey | |
| 4,539,867 A | * | 9/1985 | Ishimi | 475/169 |
| RE33,453 E | * | 11/1990 | Karlsson et al. | 384/486 |
| 5,642,751 A | * | 7/1997 | Crawley | 137/340 |
| 7,037,026 B2 | * | 5/2006 | Ostling et al. | 403/371 |

FOREIGN PATENT DOCUMENTS

| | | |
|---|---|---|
| EP | 0 455 896 | 11/1991 |
| EP | 1 035 378 | 9/2000 |
| FR | 1 597 230 | 6/1970 |
| FR | 2 058 738 | 5/1971 |
| FR | 2782152 | 2/2000 |
| GB | 1 250 979 | 10/1971 |
| NL | 6 903 450 | 9/1970 |

* cited by examiner

*Primary Examiner*—Ken Rinehart
*Assistant Examiner*—Sarah E. Suereth

(57) ABSTRACT

A device for controlling the gas-burner rings of a cooking surface includes a gas tap equipped with a control knob and a catenary element for control of ignition of the gas-burner rings. The catenary element includes a microswitch actuated selectively by a bushing carried via snap action by an axially mobile element of the gas tap provided with the control knob. The bushing is made of a synthetic plastic material and includes a sleeve for installation on the mobile element of the gas tap and a flange configured to bear upon the microswitch to actuate it as a result of a motion of translation of the mobile element of the gas tap. The bushing is internally provided with a detent and has a radial slit, which interrupts its continuity and in a corresponding angular position of which the bushing is also provided with a pair of opposed circumferential slots that interrupt the continuity of the detent.

10 Claims, 1 Drawing Sheet

UNIVERSAL INTEGRATED DEVICE FOR CONTROLLING GAS-BURNER RINGS OF A COOKING SURFACE INCLUDING A GAS TAP AND A CATENARY ELEMENT

RELATED APPLICATIONS

The present application is based on, and claims priority from, Italian Application Number TO2003A 000581, filed Jul. 25, 2003, the disclosure of which is hereby incorporated by reference herein in its entirety.

The present invention relates to a universal integrated device for controlling gas-burner rings of a cooking surface, including a gas tap and a catenary element.

BACKGROUND OF THE INVENTION

Known devices for controlling gas-burner rings of a cooking surface (both of the type which can be installed built-in and of the type forming part of a combined electrical household appliance, including, for example, an oven and/or a dish-washer) comprise for each gas-burner ring a gas tap and a catenary element provided with microswitch, actuation of which energizes a service gas-lighter circuit of the cooking surface, of a known type, which produces a spark on one or all of the gas-burner rings. In general, the gas tap is provided with an axially mobile and rotatable element, equipped with a control knob, rotation of which (possible, for safety reasons, only by a simultaneous axial translation of the mobile element) enables supply of the combustible gas to the gas-burner ring.

In order to guarantee ignition of the combustible gas as this is supplied to the gas-burner ring, the axial movement of the mobile element/control knob is used also to actuate the microswitch, thus producing generation of the ignition spark simultaneously with supply of gas.

In known devices the microswitch is actuated either via a contrast element carried by the mobile element of the gas tap, a contrast element which in general consists of a snap ring or else a bushing fixed on the mobile element of the gas tap via a snap ring, or else via a contrast shoulder made directly on the control knob.

The solutions of the first type, however, can be applied only in the presence of catenaries with spring actuation (which are more costly than the springless ones), in so far as, in order to enable installation of the bushing and/or of the snap ring, both must present a sufficiently extensive radial discontinuity in the angular direction so as to enable its deformation to fix it via snap action. Said discontinuity, in fact, in the absence of a spring, would not guarantee actuation of the microswitch in any angular position for installation of the bushing/snap ring.

The solution of the second type, which uses the control knob as contrast member, is costly and inconvenient, in so far as it does not enable use of catenaries of a standard type, but it is necessary to provide catenaries specifically tailored for each type of cooking surface.

SUMMARY OF THE INVENTION

The purpose of the present invention is to provide a control device of the type referred to above, which will, however, be free from the drawbacks described. In particular, a purpose of the invention is to provide a device for controlling gas-burner rings of a cooking surface which can use a catenary of a standard type, irrespective of whether it is of the type with spring actuation or otherwise, at the same time guaranteeing actuation of the microswitch in any position of installation, and which will be moreover inexpensive to produce, easy and fast to install, and present small overall dimensions and a high degree of reliability.

According to the present invention a device for controlling gas-burner rings of a cooking surface is provided as defined in claim 1.

In particular, according to the invention, the device includes: a contrast element consisting of a bushing made of an elastic material and comprising a sleeve for installation on a mobile element of a gas tap; and a flange designed to bear upon a microswitch. The bushing is provided with an annular detent set radially on the inside and has a radial slit, which interrupts its continuity without reducing appreciably the angular extent of the flange. In an angular position corresponding to that of said slit, the bushing is moreover provided with a pair of radially opposed internal circumferential slots, which interrupt the continuity of the detent.

In this way, since the angular extent of the slit in a position corresponding to the flange is in the region of a few tenths of a millimeter (preferably approximately five tenths of a millimeter), the bushing can assume any relative angular position with respect to the microswitch and to the respective catenary element, always ensuring, however, the possibility of a continuity of contact between the flange and the microswitch when the mobile element of the gas tap is actuated.

Furthermore, the bushing is sufficiently elastic to be installed, via snap action, on the mobile element of the gas tap and, in the case where maintenance operations are required, to be easily removed using a suitable tool (for example a screw-driver). At the same time, the bushing is sufficiently rigid, once it is installed on the mobile element of the gas tap, as not to require the use of a snap ring for axial fixing, which makes possible smaller overall dimensions, low costs and a high degree of simplicity of installation.

According to a further aspect of the invention, the detent is shaped and positioned so that the bushing may be installed on said mobile element of the gas tap in a reversible position, in such a way that it is possible to adjust the travel of the microswitch simply by installing the bushing engaged in the same annular seat but with the flange more or less close to the microswitch.

BRIEF DESCRIPTION OF THE DRAWINGS

Further characteristics and advantages of the present invention will emerge clearly from the following description of an embodiment thereof, provided purely by way of non-limiting example and with reference to the figures of the annexed drawings, in which.

DETAILED DESCRIPTION OF THE INVENTION

Figure 1:
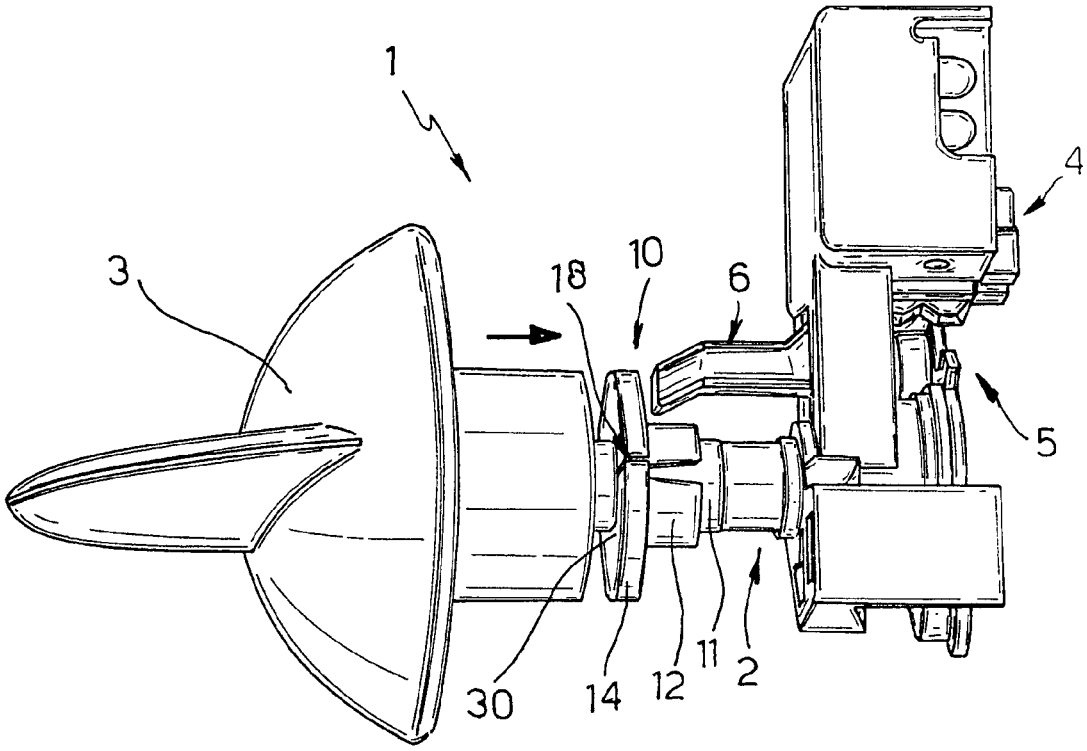
FIG. 1 is a perspective view from above of a control device provided according to the invention.
Figure 2:
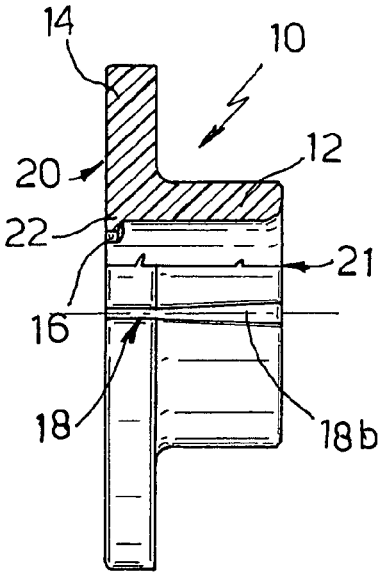
FIGS. 2 and 3 are two orthogonal views at an enlarged scale of an essential detail of the device of FIG. 1.
Figure 3:
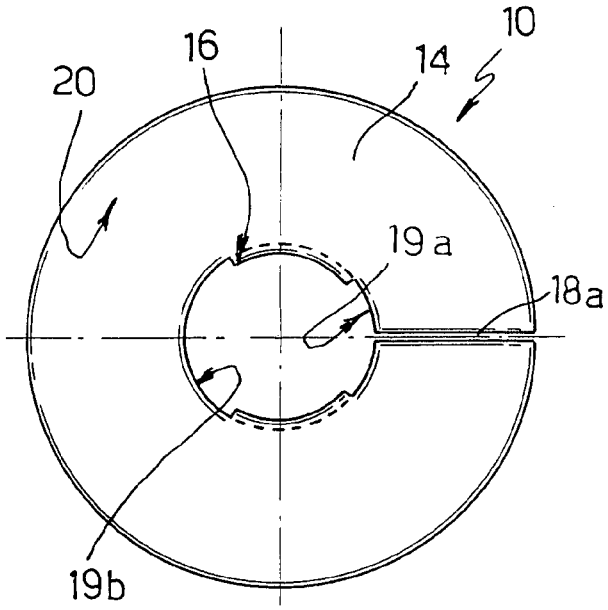

According to what is illustrated in FIGS. 1-3, designated as a whole by 1 is a device for controlling the gas-burner rings of a cooking surface (known to the art and not illustrated for reasons of simplicity), comprising a gas tap 2 equipped with a control knob 3 and an element 4 of a catenary 5 (which is as a whole known and of which, consequently, only the element 4 is illustrated for reasons of simplicity) for control of ignition of said gas-burner rings of the aforesaid cooking surface (known and not illustrated).

According to the invention, the catenary 5 is a catenary of a standard type, preferably of the type actuated without springs, and the catenary element 4 comprises a microswitch 6, which is also of a known type and is actuated selectively by a contrast element 10 carried by an axially mobile element 11 of the gas tap 2. The element 11, which is also known as a whole, is provided fixed thereto with the knob 3, on an end opposite to the one coupled to the catenary 5.

According to the invention, the contrast element 10 consists of a bushing, illustrated in greater detail in FIGS. 2 and 3, which is coupled directly, via snap action, on the mobile element 11 of the gas tap 2. The bushing 10 is made of an elastic material, preferably of a synthetic plastic material with which the bushing 10 itself is injection-moulded.

The bushing 10 comprises: a mounting sleeve 12 for installation on said mobile element 11 of the gas tap 2; and a flange 14 designed to bear in use upon the microswitch 6 to actuate it as a result of a motion of translation of the mobile element 11 of the gas tap 2, said motion of translation (which takes place in the direction of the arrow illustrated in FIG. 1) being exerted on the element 11 by the user, via the knob 3, whenever the element 11 itself is rotated to enable supply of combustible gas via the tap 2 to the desired gas-burner ring.

The bushing 10 is provided with an annular detent 16, set radially on the inside, and has a radial slit 18, which interrupts its continuity without reducing appreciably the angular extent of the flange 14. In an angular position corresponding to that of the slit 18, the bushing 10 is moreover provided with a pair of circumferential slots 19*a*, 19*b*, radially internal and opposed, which interrupt the continuity of the detent 16, as is clearly illustrated in FIG. 3.

The angular extent of the slots 19*a*, 19*b*, which are preferably shaped like key seats (FIG. 3) is much greater (of at least one order of magnitude) than that of the slit 18. In particular, the slit 18 is divided into two portions 18*a* and 18*b* so that the angular extent of the radial slit 18 through the flange 14 (portion 18*a*) is of the order of a few tenths of a millimeter (approximately five tenths of a millimeter), whilst the angular extent of the slit 18 through the mounting sleeve 12 (portion 18*b*) is sensibly greater. Furthermore, in a position corresponding to the sleeve 12, the angular extent of the slit 18 continues to widen out progressively as it recedes from the flange 14 so that the portion 18*b* has a flared configuration, which simplifies production of the bushing 10 by moulding.

The detent 16 is carried by the mounting sleeve 12 in an axial position corresponding to that of the flange 14, and the slots 19*a*, 19*b* are made flush with a first front surface 20 of the flange 14, facing, on the opposite side, a first end 21 of the sleeve 12, and extend starting from the front surface 20 and inside the sleeve 12, throughout the axial extent of the detent 16.

The detent 16 is coupled, in use, with an annular seat 30 (FIG. 1), of the known type used for housing snap rings. The seat 30 is made on an external side surface of the mobile element 11 of the gas tap 2.

The flange 14 is preferably made with the first front surface 20 set flush with a second end 22 of the mounting sleeve 12, opposite to the end 21.

Furthermore, according to an important aspect of the invention, the detent is shaped and positioned so that the bushing 10 may be installed on the mobile element 11 of the gas tap 2 in a reversible position, i.e., with the sleeve 12 projecting axially from the flange 14, which in use faces the microswitch 6 or else faces the opposite side with respect to the microswitch 6 itself. In this way, the distance of the flange 14 from the microswitch 6 can be varied without modifying the position of the seat 30, thus enabling adjustment of the travel of the microswitch 6, maintaining the same catenary 5.

The opposed slots 19*a*, 19*b* preferably have a different angular extent. In particular, one first slot 19*a*, which is set adjacent to the slit 18 (in the case in point to the portion 18*a*) and communicates therewith, has an angular extent smaller than that of the second slot 19*b*, which is set in a position diametrally opposite to the slot 19*a*.

In this way, the stiffness/elasticity of the bushing 10 can be optimized, as desired, according to the dimensions of the seat 30 available on the gas tap 2.

Preferably, the annular seat 30 is moreover chosen so as to have an axial extent greater than that of an ordinary seat for a snap ring, and likewise the annular detent 16 has an axial extent (thickness) greater than the usual thickness of a snap ring.

The invention claimed is:

1. A device for controlling the gas-burner rings of a cooking surface, said device comprising:

a gas tap equipped with a control knob;

an axially mobile element carried by the gas tap, the mobile element further comprising an annular seat disposed on an external side surface of said mobile element;

a catenary element operable to ignite the gas-burner rings, the catenary element comprising a microswitch; and a contrast element carried axially by the mobile element, said contrast element comprising a bushing fitted directly, via snap action, on said mobile element, the bushing further comprising:

a mounting sleeve configured to mount the contrast element on said mobile element;

a circular flange, any angular portion thereof configured to bear upon said microswitch and actuate said microswitch as a result of an axial motion of the mobile element;

a radially internal annular detent configured to lockingly engage the mobile element;

a radial slit interrupting the continuity of the flange; and a pair of radially opposed internal circumferential slots disposed in an angular position corresponding to that of said slit the pair of radially opposing internal circumferential slots interrupting the continuity of the detent.

2. The control device according to claim 1, wherein the angular extent of said slots is much greater than that of said slit.

3. The control device according to claim 1, wherein said slots are shaped like key seats.

4. The control device according to claim 1, wherein said detent is carried by said mounting sleeve, in an axial position corresponding to that of said flange;

said slots being made flush with a first front surface of said flange, facing, on the opposite side of the flange, a first end of said mounting sleeve, said slots extending, starting from said first front surface of the flange and within said mounting sleeve, throughout the axial extent of said detent.

5. The control device according to claim 4, wherein said first front surface of said flange is set flush with a second end of said mounting sleeve opposite to the first end of the mounting sleeve.

6. The control device according to claim 1, wherein said bushing is made of a synthetic plastic material by injection molding.

7. The control device according to claim 1, wherein the angular extent of said radial slit through said flange is approximately a few tenths of a millimeter;

said slit having a greater angular extent through said mounting sleeve;

said angular extent of the slit widening progressively, in an area corresponding to said sleeve, as said slit recedes from the flange.

8. The control device according to claim 1, wherein said detent is shaped and positioned so that said bushing may be installed on said mobile element of the gas tap in a reversible position.

9. The control device according to claim 1, wherein said opposing slots include first and second slots, and wherein said first slot is set adjacent to said slit and comprises an angular extent smaller than that of the second slot opposite to the first slot.

10. A bushing configured to be installed on a device for controlling the gas-burner rings of a cooking surface, said device comprising:

a gas tap equipped with a control knob;

a catenary element operable to ignite the gas-burner rings, the catenary element comprising a microswitch selectively actuated by a contrast element carried axially by a mobile element of the gas tap, wherein said contrast element comprises said bushing fittable directly, via snap action, on said mobile element of the gas tap, the bushing comprising:

a mounting sleeve configured to mount said bushing on said mobile element, and a circular flange, any angular portion of said flange being configured to bear upon said microswitch to actuate said microswitch as a result of an axial motion of the mobile element;

a radially internal annular detent and a radial slit that interrupts the continuity of the flange; and a pair of radially opposed internal circumferential slots disposed in an angular position corresponding to an angular position of the slit that interrupt the continuity of the detent;

wherein said mobile element further comprises an annular seat disposed on an external side surface of the mobile element and the detent is configured to lockingly engage the annular seat.

* * * * *